US006481618B2

(12) United States Patent
Persson

(10) Patent No.: US 6,481,618 B2
(45) Date of Patent: Nov. 19, 2002

(54) DIVISIBLE TRANSPORT BOX

(75) Inventor: Håkan Persson, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/963,538

(22) Filed: Sep. 27, 2001

(65) Prior Publication Data

US 2002/0040924 A1 Apr. 11, 2002

Related U.S. Application Data

(60) Provisional application No. 60/235,887, filed on Sep. 28, 2000.

(51) Int. Cl.[7] ..... B65D 5/54

(52) U.S. Cl. ..... 229/120.011; 229/120.18; 229/120.21

(58) Field of Search ..... 229/120.01, 120.08, 229/120.17, 120.18, 120.21, 120.011, 157, 158

(56) References Cited

U.S. PATENT DOCUMENTS

| | | | | |
|---|---|---|---|---|
| 2,973,129 A | * | 2/1961 | Stone et al. | 229/157 |
| 3,144,190 A | * | 8/1964 | Holt et al. | 229/120.17 |
| 3,158,312 A | * | 11/1964 | Simkins | 229/120.011 |
| 3,341,103 A | * | 9/1967 | May | 229/120.18 |
| 3,677,458 A | | 7/1972 | Gosling | |
| 4,467,923 A | * | 8/1984 | Dornbusch et al. | 229/120.011 |
| 4,817,803 A | * | 4/1989 | Risucci | 229/120.17 |
| 4,919,269 A | * | 4/1990 | Wright et al. | 229/120.08 |
| 4,932,534 A | * | 6/1990 | Focke et al. | 229/120.011 |
| 5,505,370 A | | 4/1996 | Brown et al. | |

FOREIGN PATENT DOCUMENTS

| | | |
|---|---|---|
| EP | 0 816 237 | 1/1998 |

* cited by examiner

*Primary Examiner*—Gary E. Elkins
(74) *Attorney, Agent, or Firm*—Young & Thompson

(57) ABSTRACT

A transport box (1) formed from a blank of cardboard, corrugated board or like material, having a bottom section (2) with end flaps (3), atop section (4) with end flaps (5), and longitudinal side walls (6) with end flaps (7, 8), the end flaps forming at least part of an end wall. Each side wall has an upper part (6') with an end flap (7) at each end, and a lower part (6") with an end flap (8) at each end, the upper part (6') being connected to the lower part (6") via two folded-in edges (9, 10) which are parallel to the bottom section and form a fold. The edges are delimited by parallel fold lines (11, 12, 13), of which a first fold line (11) is situated between the first folded-in edge (9) and the upper part (6'), a second fold line (12) is situated between the second folded-in edge (10) and the lower part (6"), and a third fold line (13) is situated between the two edges (9, 10). The end flaps (7) on the upper part (6') of the side wall are connected to the end flaps (5) of the top section, and the end flaps (8) on the lower part (6") of the side wall are connected to the end flaps (3) of the bottom section.

6 Claims, 4 Drawing Sheets

DIVISIBLE TRANSPORT BOX

This application claims benefit of provisional application No. 60/235,887, filed Sep. 28, 2000.

TECHNICAL FIELD

The present invention relates to a storage or transport box which is made of cardboard, corrugated board or like material and can be divided into smaller packages, having a bottom section with end flaps, a top section with end flaps, and longitudinal side walls with end flaps, where the end flaps form at least part of an end wall at each end of the transport box.

PRIOR ART

Transport boxes made of cardboard, corrugated board or the like are already known. It is also already known for such transport boxes to be able to be divided into at least two smaller units. An example of such a transport box with a top section, a bottom section and side walls is described in DE 296 11 809 U1. The transport box is formed from two separate blanks, of which one blank forms the bottom section, top section and side, and the other blank forms the other sides of the transport box. The transport box can be divided into two separate units which, after removal of the side walls, form two storage trays. These trays are primarily intended to be used for displaying goods in shops in a way which makes the goods accessible to the customers.

A disadvantage of these trays is that they are not suited for further transport on account of their construction with a bottom and straight side walls, without anything to restrict an object in the tray from moving along the walls in the direction out of the tray, which means that an object in the tray can drop out of the tray if shaking occurs during transport. A further disadvantage is that the trays cannot be stacked one upon the other, which can cause problems during transport or storage.

DISCLOSURE OF THE INVENTION

The object of the present invention is to remedy the abovementioned disadvantages and provide a transport box which can be divided into smaller storage trays which are suitable for transport and can be stacked. Another object of the invention is to produce such a box from only one blank. By virtue of the fact that the transport box can be divided into smaller transport trays, the user has a greater choice regarding the size or quantity of the goods which can be transported or stored in the box.

According to the present invention, a transport box has therefore been developed which is formed from a blank of cardboard, corrugated board or like material, having a bottom section with end flaps, a top section with end flaps, and longitudinal side walls with end flaps, the end flaps forming at least part of an end wall. The transport box is characterized in that each side wall has an upper part with an end flap at each end, and a lower part with an end flap at each end, the upper part being connected to the lower part via two folded-in edges which are parallel to the bottom section and form a fold. The edges are delimited by parallel fold lines, of which a first fold line is situated between the first folded-in edge and the upper part, a second fold line is situated between the second folded-in edge and the lower part, and a third fold line is situated between the two edges. The end flaps on the upper part of the side wall are connected to the end flaps of the top section, and the end flaps on the lower part of the side wall are connected to the end flaps of the bottom section.

The folded-in edges are expediently provided with fastening arrangements which can be formed by means of end flaps from the first edge being connected to the end flaps from the upper part of the side wall, while end flaps from the second edge are connected to the end flaps from the lower part of the side wall. The transport box can be divided into two storage trays or transport trays by separating the upper part from the lower part along the third fold line. The third fold line is advantageously perforated or in some other way weakened in order to facilitate separation.

After separation, two stackable trays are thus obtained with an edge folded in from each longitudinal side wall, which edge holds the contents in place upon separation and gives the trays stability in order to increase their stackability. The end flaps of the edges can be designed such that they can hook securely through a slit arranged in a corresponding end flap from the side wall in a manner which is already known for fastening two adjoining sections to each other. The end flaps from the edges can also be connected to the end flaps from the side walls by means of glue.

BRIEF DESCRIPTION OF THE DRAWINGS

The invention will now be described in greater detail with reference to the attached figures, in which.

PREFERRED EMBODIMENTS

Figure 1:
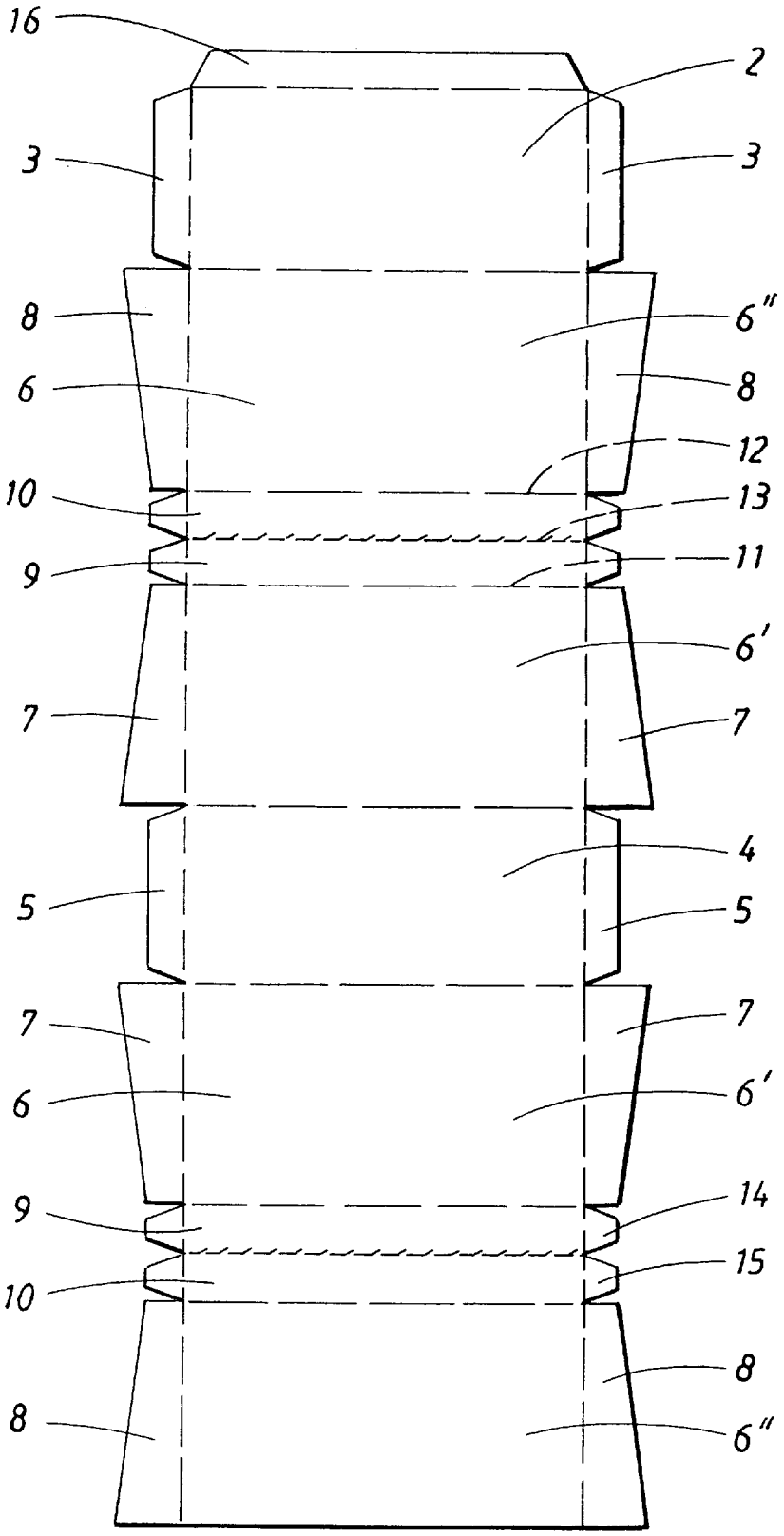
FIG. 1 shows a cut-out, unfolded blank for a transport box according to the invention.

FIG. 1 shows a cut-out, unfolded blank of cardboard or corrugated board for a transport box 1 (not shown in FIG. 1) according to the invention. The blank comprises a bottom section 2 with an end flap 3 at each end, a top section 4 with an end flap 5 at each end, and longitudinal side walls 6 with end flaps 7, 8. Each side wall has an upper part 6' with an end flap 7 at each end, and a lower part 6" with an end flap 8 at each end. Fold lines are arranged in a manner known per se between the various sides and between these and the respective end flaps.

The upper part of the side wall is connected to the lower part via two parallel edges 9, 10. The edges are delimited by parallel fold lines 11, 12, 13, of which a first fold line 11 is situated between the first folded-in edge 9 and the upper part 6', a second fold line 12 is situated between the second folded-in edge 10 and the lower part 6", and a third fold line 13 is situated centrally between the two edges 9, 10. An end flap 14 is situated at each end of the first edge, and an end flap 15 is situated at each end of the second edge.

To assemble a transport box 1 starting from a blank according to FIG. 1, the side walls 6 are folded down in relation to the top section 4, the bottom section 2 is folded back and connected to the opposite side wall 6 with a connecting flap 16, and the edges 9, 10 are folded in so that they form an inwardly directed fold on each side wall. The transport box is then kept in the assembled state by means of the end flap 5 of the top section 4 being connected at each end to the end flaps 7 on the upper part 6' of each side wall, and by means of the end flap 3 of the bottom section 2 being connected to the end flaps 8 on the lower part 6" of each side wall. The end flaps are advantageously connected to each other with glue in the areas where they overlap each other. The end flaps thus cover parts of the end walls on opposite sides of an assembled transport box.

The end flaps 14, 15 which are placed at each end of the edges 9, 10 are intended to be connected to the end flaps 7, 8 from the side walls 6 when the transport box is in an assembled state. The end flap 14 at each end of the first edge 9 is intended to be connected to the end flap 7 at each end of the upper part 6' of the side wall, while the end flap 15 at each end of the second edge 10 is intended to be connected to the end flap 8 at each end of the lower part 6" of the side wall.

Figure 2:
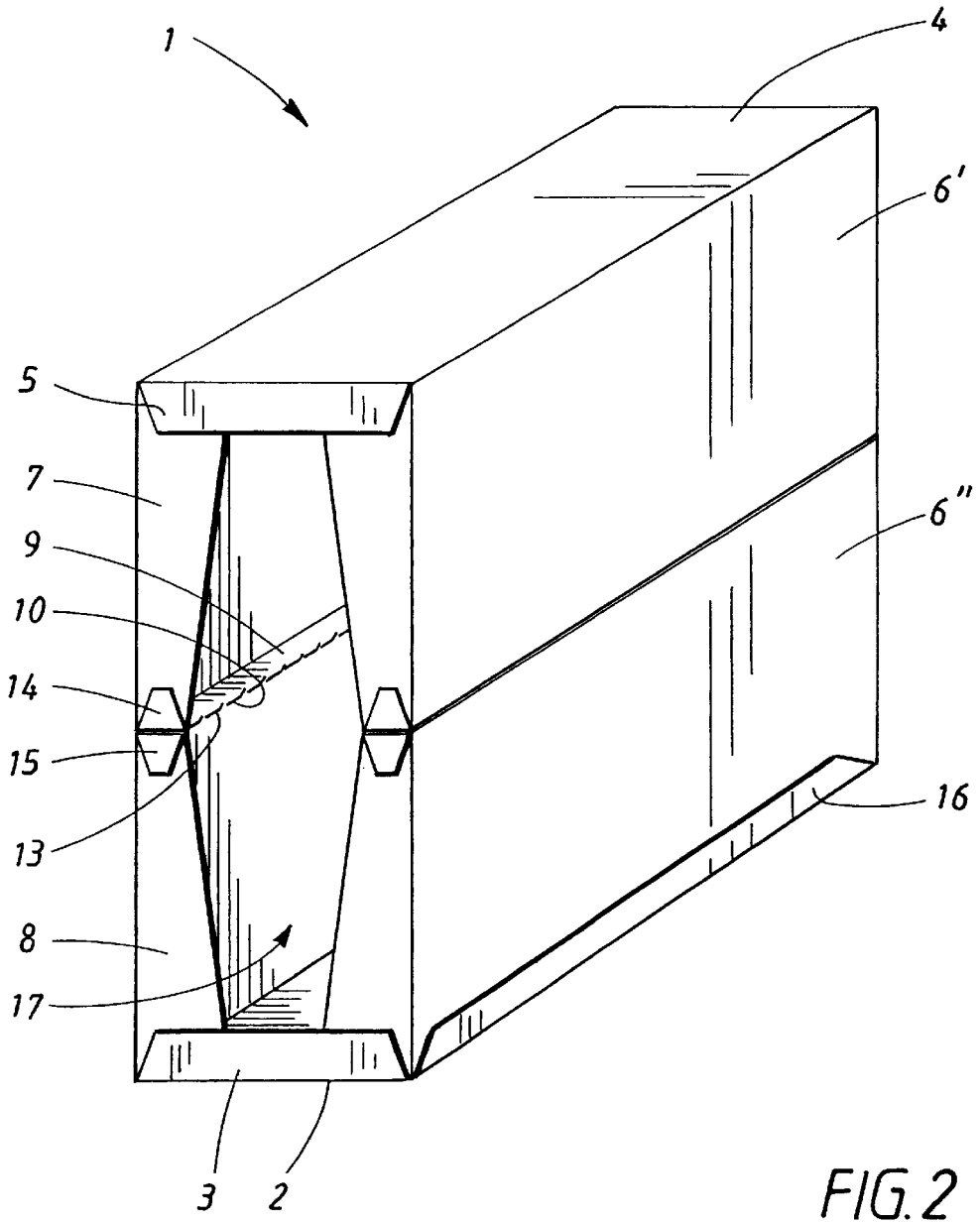
FIG. 2 shows an embodiment of an assembled transport box according to the invention.

FIG. 2 shows a transport box 1 according to the invention in the assembled state. The transport box has a bottom section 2, a top section 4 and two opposite longitudinal side walls 6 and two opposite transverse end walls 17.

Each transverse end wall 17 comprises an end flap 3 folded from the bottom section 2, an end flap 5 folded from the top section 4, and two end flaps 7, 8 folded from each side wall 6, which end flaps form part of an end wall with an opening in the middle, at each end of the transport box. Alternatively, the end flaps which are folded over the end wall can be formed in such a way that they cover the whole end wall individually or jointly.

Each side wall has an upper part 6' with an end flap 7 at each end, and a lower part 6" with an end flap 8 at each end, the upper part 6' being connected to the lower part 6" by means of two edges 9, 10 which are parallel to the bottom section and are folded in and form a fold. The edges divide the side wall into an upper part and a lower part, while they also form a boundary fold on the inside of the package, so that the interior of the transport box also has an upper part and a lower part. The edges are preferably positioned centrally on each side wall so that the upper part of the side wall is the same size as the lower part of the side wall. Of course, the edges do not need to be centrally positioned on the side wall, and instead it may also be desirable for the edges to divide the transport box in a way which allows the upper part of the package to be smaller or larger than the lower part of the package.

The end flaps 7 from the upper part of the side wall are connected to the end flaps 5 of the top section, and the end flaps 8 from the lower part of the side wall are connected to the end flaps 3 of the bottom section. The end flaps are joined together with glue in the areas where they overlap each other and in this way the transport box is maintained in the assembled state. The box can of course be turned so that the bottom section instead forms the top section of the box. The end flaps can also be connected to each other by means of other fastening arrangements known in this field, for example tapes or staples.

The edges are held in place by means of the fact that at each end wall the end flap 14 which is folded from the first edge 9 has been secured to the end flap 7 which is folded from the upper part 6' of the side wall and the end flap which is folded from the second edge 10 has been secured to the end flap 8 which is folded from the lower part 6" of the side wall. The securing of the flaps can be advantageously effected by their being glued to each other. To obtain a connection which can be released, the flaps which are folded from the edge can be designed in such a way that they hook securely through a slit arranged on the respective end flap folded from the side walls, a so-called slit and hook fastening.

In FIG. 2, the third fold line 13 has been perforated in order to facilitate division of the box. The upper part of the box is separated from the lower part along the third fold line, as a result of which two transport trays 19 are obtained. Alternatively, the separation can be done using a cutting tool, in which case the third fold line does not need to be perforated. Other known arrangements or methods for separating a part of a package from another part of the package along a predetermined line are of course also suitable.

Figure 3:
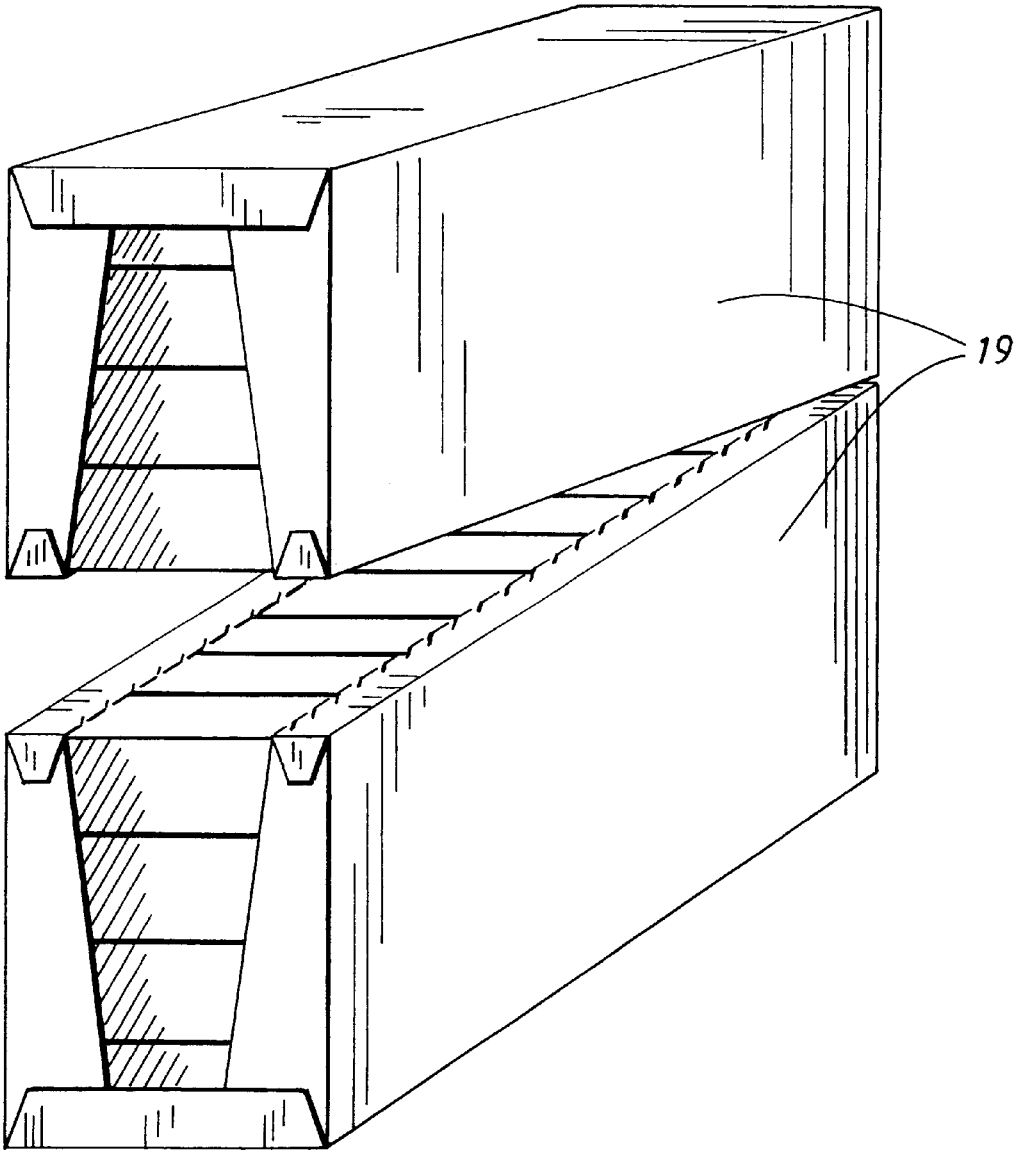
FIG. 3 shows the division of a transport box according to the invention into two smaller transport boxes.

FIG. 3 shows the division of the transport box 1. Since it is the fold line placed between the first and second edges which has been perforated, or along which the division takes place, both trays 19 thus comprise a folded edge over the contents after separation. The folded edge thus holds the contents in place in the respective part of the transport box upon division into two smaller trays 19.

Figure 4:
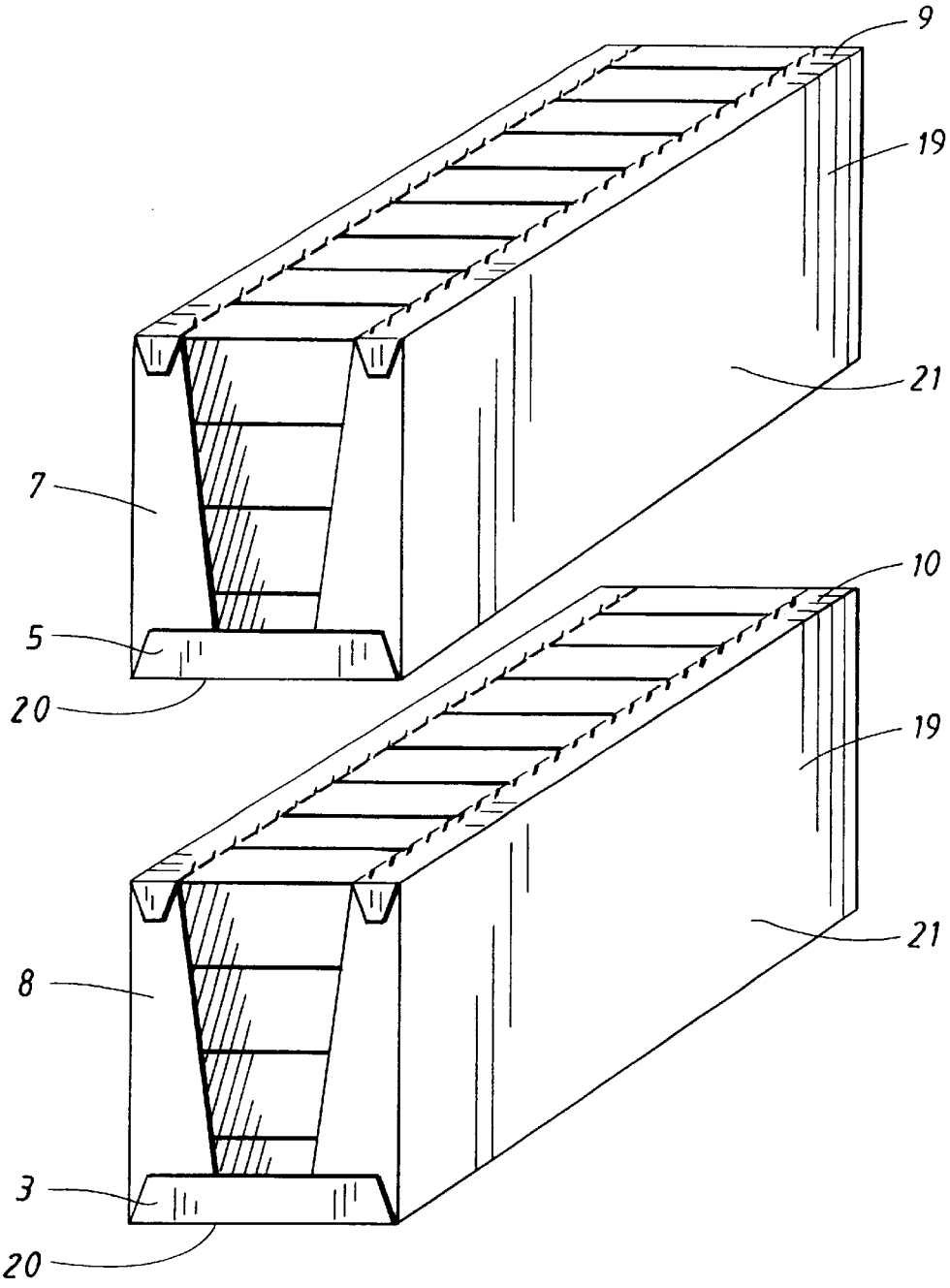
FIG. 4 shows the design of two smaller transport boxes obtained by dividing a transport box according to the invention.

FIG. 4 shows in detail the design of the two trays 19 after separation and after turning of the upper part of the transport box through 180°. The bottom section 2 and the top section 4 of the original transport box 1 each form a base 20 of the two trays 19. The upper parts 6' of the side walls of the original transport box form the side walls 21 of one tray 19, while the lower parts 6" of the side walls of the original transport box form the side walls 21 of the other tray 19. The end flaps 5 from the top section and the end flaps 7 from the upper parts 6' of the side walls of the original transport box 1 form end walls of one tray 19, while the end flaps 3 from the bottom section 2 and the end flaps 8 from the lower parts 6" of the side walls form the end walls of the other tray 19. The edges 9, 10 folded in over the contents mean that the trays 19 have sufficient stability so that several trays can be stacked one upon the other.

The transport trays 19 which are obtained after division of a transport box 1 according to the invention can also advantageously be used as storage trays for removal of individual items in a shop, for example. An edge 9, 10 which is secured by flaps from the edge hooking securely through an opening in an end flap can be folded aside, after the hook fastening has been released, in order to facilitate removal of the contents from the storage tray.

A transport tray 19 with glued end flaps from the edges 9, 10 is expediently used for removing flexible goods by hand. The width of the edges which hold the flexible products in the respective tray 19 is then expediently adapted such that just a slight compression of the first product to be removed is needed in order to take it out of the tray without needing to tear the blank. One side or end wall can also be provided with a perforation or some other form of opening arrangement in order to allow the contents of the box to be accessed from the sides.

The invention must not be seen as being limited to the embodiments described above, and instead it can be varied in different ways within the scope of the claims.

What is claimed is:

1. Transport box formed from a blank of cardboard or corrugated board, having a bottom section with end flaps, a top section with end flaps, and longitudinal side walls with end flaps, the end flaps forming at least part of an end wall at each end of the transport box, wherein each side wall has an upper part with an end flap at each end, and a lower part with an end flap at each end, the upper part being connected to the lower part via two folded-in edges which are parallel to the bottom section and form a fold, said folded-in edges being delimited by parallel fold lines; a first fold line being situated between the first folded-in edge and the upper part, a second fold line being situated between the second folded-in edge and the lower part, and a third fold line being situated between the two edges; the end flaps from the upper part of the side wall being connected to the end flaps of the top section; and the end flaps from the lower part of the side wall being connected to the end flaps of the bottom section.

2. The transport box according to claim 1, wherein the third fold line is perforated or weakened in order to facilitate the separation of the upper part from the lower part along the third fold line for dividing the transport box into two transport or storage trays.

3. The transport box according to claim 1, wherein the folded-in edges are centrally positioned on each side wall so that the upper part and the lower part are the same size.

4. The transport box according to claim 1, wherein end flaps from the first edge are connected to the end flaps from the upper part of each side wall, and end flaps from the second edge are connected to the end flaps from the lower part of each side wall.

5. The transport box according to claim 4, wherein the connection between the end flaps from the first and second edges, respectively, and the end flaps from the upper and lower parts, respectively, of each side wall can be released.

6. The transport according to claim 4, wherein the end flaps are connected with glue.

* * * * *